US007658236B2

(12) United States Patent
Howson et al.

(10) Patent No.: US 7,658,236 B2
(45) Date of Patent: Feb. 9, 2010

(54) IMPLEMENT POSITIONING ASSEMBLY FOR A MACHINE

(75) Inventors: Brian Howson, Peoria, IL (US); Glen A. Spindel, Divernon, IL (US); Kevin L. Martin, Washburn, IL (US)

(73) Assignee: Caterpillar Inc., Peoria, IL (US)

( * ) Notice: Subject to any disclaimer, the term of this patent is extended or adjusted under 35 U.S.C. 154(b) by 73 days.

(21) Appl. No.: 11/588,787

(22) Filed: Oct. 27, 2006

(65) Prior Publication Data

US 2008/0110648 A1 May 15, 2008

(51) Int. Cl.
*E02F 3/00* (2006.01)
*A01B 51/00* (2006.01)

(52) U.S. Cl. ..... 172/780; 172/272; 172/789

(58) Field of Classification Search ..... 172/780, 172/781, 784, 789, 272, 253, 254, 793, 817; 37/266, 267, 403, 407–410, 274, 280, 281, 37/105, 903; 414/788, 331.1
See application file for complete search history.

(56) References Cited

U.S. PATENT DOCUMENTS 2,799,099 A * 7/1957 Leliter ..... 172/667
3,241,254 A 3/1966 Ulrich
3,822,756 A 7/1974 Martin
3,876,092 A 4/1975 MacDonald
3,891,065 A * 6/1975 Iijima et al. ..... 188/41
4,074,767 A * 2/1978 Cole ..... 172/781
4,084,643 A * 4/1978 Easterling ..... 172/795
4,320,589 A * 3/1982 Pelazza ..... 37/232
4,635,730 A * 1/1987 Larsson ..... 172/788
4,643,261 A 2/1987 Long
4,677,814 A * 7/1987 Anderson et al. ..... 56/15.6
4,683,959 A * 8/1987 Clemens ..... 172/795
5,687,800 A * 11/1997 Wilkening ..... 172/811
5,695,013 A 12/1997 Waldron
5,779,431 A * 7/1998 Alm et al. ..... 414/812
5,795,096 A 8/1998 Culver
6,145,224 A 11/2000 Stickling (Continued)

OTHER PUBLICATIONS

U.S. Appl. No. 11/443,066, filed May 31, 2006, Butler et al.

*Primary Examiner*—Robert E Pezzuto
*Assistant Examiner*—Matthew D Troutman
(74) *Attorney, Agent, or Firm*—Liell & McNeil

(57) ABSTRACT

A machine includes a frame and a coupler assembly suspended below the frame, the coupler assembly configured for sideshift movement and having an implement mounting element for engaging with a mating feature on an implement. An implement grabber mounted to the coupler assembly is configured to grab an implement and move the implement via sideshift movement of the coupler assembly from a position lateral of the frame to a mounting position at which the mounting element of the coupler assembly can engage with the mating feature of the implement. A method of implement positioning for a machine includes grabbing the implement with a implement grabber mounted on a coupler assembly and moving the implement with the coupler assembly. The method also includes disengaging the implement from the implement grabber and actuating a mounting element of the coupler assembly to engage or disengage with the mating feature of the implement. The method and machine are amenable to mounting long objects to a motor grader, which are unsuitable for pick up via conventional means.

16 Claims, 5 Drawing Sheets

U.S. PATENT DOCUMENTS

| | | | | |
|---|---|---|---|---|
| 6,249,992 | B1 | 6/2001 | Irving et al. | |
| 6,293,354 | B1 | 9/2001 | Garratt et al. | |
| 6,412,200 | B1 | 7/2002 | Savard | |
| 6,585,059 | B2 | 7/2003 | Michael, Jr. et al. | |
| 6,871,425 | B2 | 3/2005 | Feller | |
| 6,892,824 | B2 | 5/2005 | Torrey | |
| 6,904,978 | B2 | 6/2005 | McGugan | |
| 6,907,941 | B1 * | 6/2005 | Hoffart | 172/272 |
| 7,178,606 | B2 * | 2/2007 | Pecchio | 172/6 |

* cited by examiner

IMPLEMENT POSITIONING ASSEMBLY FOR A MACHINE

TECHNICAL FIELD

The present disclosure relates generally to machines and positioning and coupling strategies for implements used with a machine, and relates more particularly to an apparatus and method wherein an implement coupler assembly is movable laterally of a machine to retrieve and dispose of implements when conventional retrieval and/or disposition is not practicable.

BACKGROUND

Many modern machines used in earthworking, construction, mining, agriculture and similar industries utilize specialized implements for performing various tasks. Certain machines have long been designed to couple with and utilize a variety of implements, the implements being selected based upon the particular work performed by the machine. While the desirability of flexibility in implement-machine compatibility has long been recognized, certain machines are less amenable than others to use with different classes of implements, often because the overall machine design has traditionally been directed to relatively narrow applications. Motor graders and the like represent one group of machines which, while performing very well in certain tasks such as road grading and snow removal, have been limited in their use in nontraditional applications. As a result, motor graders often sit idle when their owners and operators would like to be able to use them. The limitation on motor graders to work in only certain applications relates to a certain extent to the overall machine design, as well as the means by which they are traditionally manufactured.

Motor graders typically include a grader blade suspended below the machine's frame, and mounted in the middle of the machine between the front and back wheels. Due to this design, a motor grader cannot swap implements as readily as certain other machines, such as loaders, which typically have front mounted implements. If an implement is to be mounted to a motor grader, the machine can in some instances be driven around the implement such that the implement coupling mechanism is positioned close enough to the implement for mounting. This approach, however, works less well, if at all, with implements that are relatively long, as the machine often cannot readily turn tightly enough due to its long frame to position the coupling mechanism close enough to the implement for easy mounting. Motor graders also often have factory installed blades, which tend to be relatively labor intensive to uncouple and replace. Despite these challenges to implement mounting, there remain strong incentives to increase the utilization of motor graders.

One means by which engineers have attempted to broaden the range of motor grader use has been via supplementary attachments which couple directly to a motor grader blade. U.S. Pat. No. 5,695,013 to Waldron is one such device, and provides a dirt distribution device that attaches to an earth moving blade of a grader. In Waldron's design, the supplementary device is mounted to an adjustable support arm that mounts the device to an outboard end of the blade. While Waldron's strategy may improve the performance of a motor grader in certain types of operations, the system falls short of adapting a motor grader for truly new uses, and requires the supplementary device to be coupled to and work in concert with the existing grader blade.

The present disclosure is directed to one or more of the problems or shortcomings set forth above.

SUMMARY OF THE INVENTION

In one aspect, the present disclosure provides a machine having a frame with a front set of ground engaging elements and at least one back set of ground engaging elements, and defining a longitudinal axis. A coupler assembly is suspended below the frame and disposed between the front set of ground engaging elements and the at least one back set of ground engaging elements. The coupler assembly is configured for movement transverse to the axis and has an implement mounting element for engaging with a mating feature of an implement. The machine further includes an implement grabber mounted to the coupler assembly and configured for grabbing an implement and moving the implement via movement of the coupler assembly to a mounting location relative to the frame at which the mounting element of the coupler assembly can engage with the mating feature of the implement.

In another aspect, the present disclosure provides an implement positioning method for a machine. The method includes grabbing an implement with an implement grabber mounted on a coupler assembly of the machine, the coupler assembly being suspended below a frame of the machine and disposed between front and back ground engaging elements of the machine. The method further includes moving the implement with the coupler assembly transverse to a longitudinal axis of the frame and toward one of a disposal location and a mounting location relative to the frame, after grabbing the implement with the implement grabber. Still further, the method includes disengaging the implement from the implement grabber, and actuating a mounting element of the coupler assembly to engage or disengage with a mating feature of the implement.

In still another aspect, the present disclosure provides an implement assembly for a machine. The implement assembly includes a coupler assembly having a front side, a back side opposite the front side and a width dimension. The coupler assembly is configured for movement relative to a frame of the machine in directions aligned with the width dimension, the implement assembly further including a mounting element configured to engage with a mating feature of an implement for mounting an implement at the front side of the coupler assembly. An implement grabber is mounted to the coupler assembly and configured for grabbing an implement and moving the implement with the coupler assembly to a mounting location at which the mounting element of the coupler assembly can engage with the mating feature of the implement.

DETAILED DESCRIPTION

Figure 1:
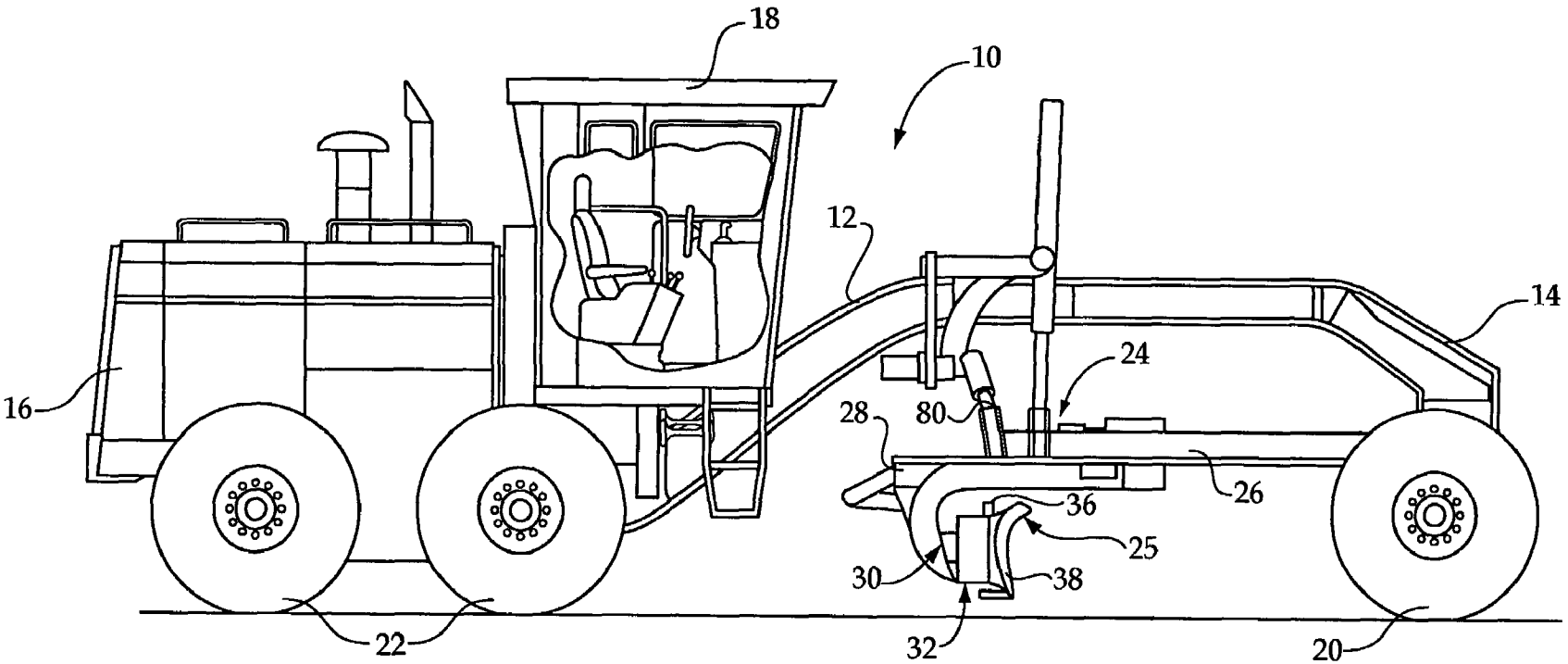
FIG. 1 is a side diagrammatic view of a machine according to one embodiment.

Referring to FIG. 1, there is shown a machine 10 having a frame 12 with a front frame unit 14 and a back frame unit 16. Machine 10 is shown in the context of a motor grader machine wherein front and back frame units 14 and 16 are configured to articulate relative to one another, however, the present disclosure is not thereby limited and non-articulated machines are contemplated herein. Machine 10 is also illustrated as having a front set of ground engaging elements 20 and at least one back set of ground engaging elements 22, for example two back sets of ground engaging elements. In other embodiments, a greater or lesser number of sets of ground engaging elements, wheels or tracks for example, might be used. Machine 10 is configured via an implement assembly 25 to retrieve and dispose of implements via sideshift movement of a coupler assembly 32, as further described herein.

Figure 2:
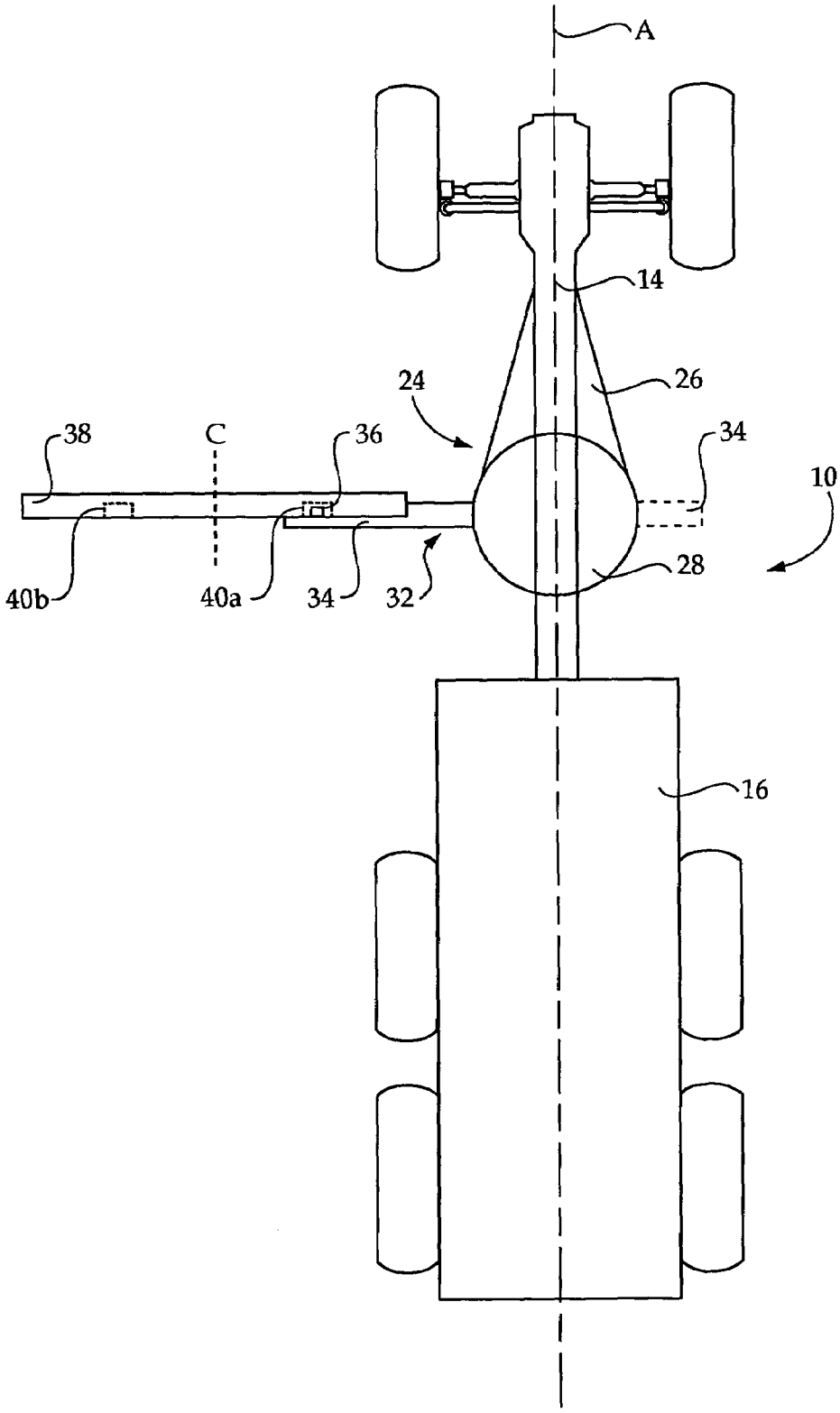
FIG. 2 is a top schematic view of a machine according to one embodiment.

Referring also to FIG. 2, coupler assembly 32 may include a coupler body 34, and may be suspended below frame 12 and disposed between front and back sets of ground engaging elements 20 and 22. Coupler assembly 32 may be configured for sideshift movement relative to a longitudinal axis A of machine 10 within a retention assembly 30 of implement assembly 25, retention assembly 30 in turn being coupled with or part of a drawbar and circle assembly 24 that includes a drawbar 26 and circle 28. Coupler assembly 32 may further include an implement grabber 36 configured for grabbing an implement 38 for retrieving and disposing of the implement via sideshift movement of coupler assembly 32. In particular, coupler assembly 32 may be movable in directions transverse to axis A to grab an implement positioned laterally of machine 10 with grabber 36, for example at a disposal location, and move the implement via sideshift movement of coupler assembly 32 to a mounting location at which the implement can be mounted to coupler assembly 32. Coupler assembly 32 may also be vertically movable relative to frame 12, enabling elevating of implement 38 to avoid dragging it across the ground when grabbed with grabber 36 and moved via coupler assembly 32.

Figure 3:
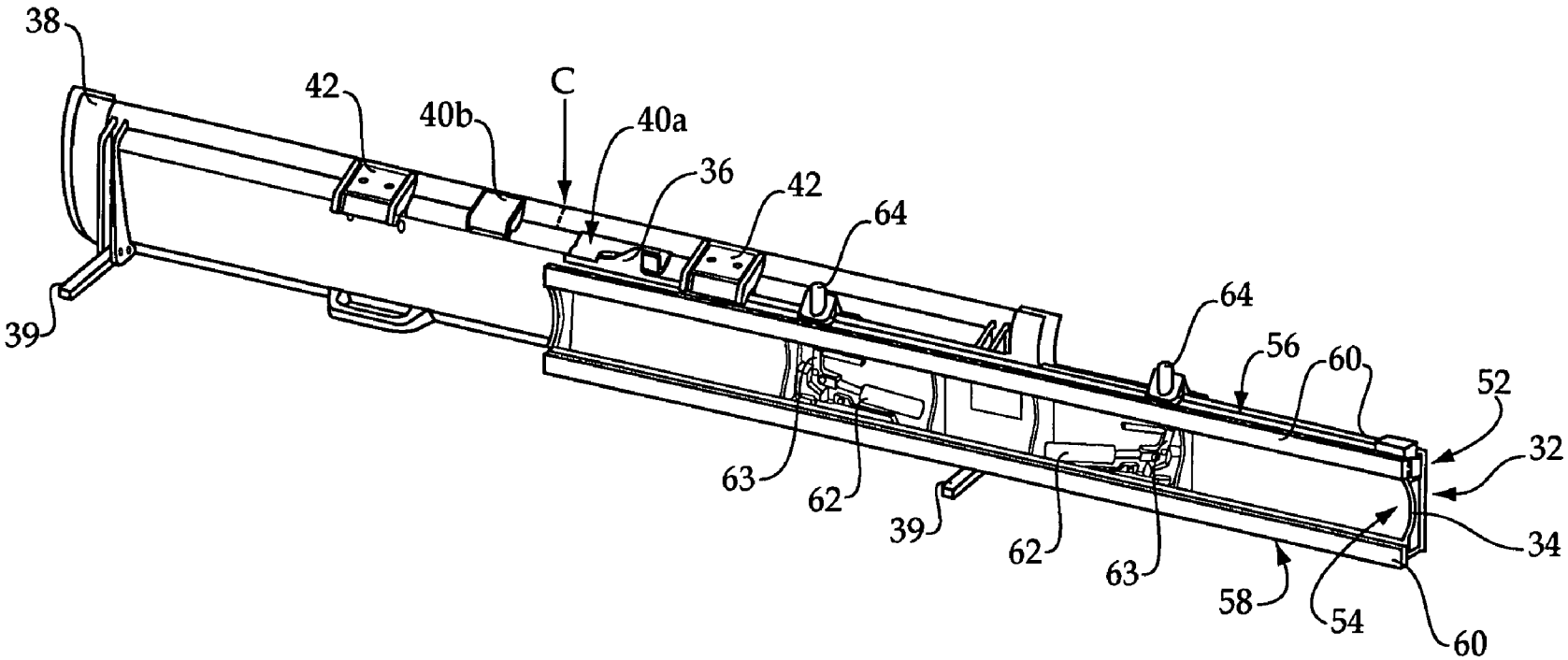
FIG. 3 is a pictorial view of a coupler assembly and implement according to one embodiment.

Referring also to FIG. 3, coupler body 34 of coupler assembly 32 may include an upper edge 56, a lower edge 58, a front side 52 and a back side 54, each of upper and lower edges 56 and 58 extending in parallel with a width dimension of coupler body 34. Coupler body 34 may also be equipped with rails 60 to facilitate sideshift movement relative to frame 12, transverse to axis A, and within retention assembly 30. Coupler assembly 32 may further be configured for mounting an implement such as implement 38 to front side 52, for example, via a movable mounting element 64 configured to engage with a mating feature 42 of implement 38. In one embodiment, the movable mounting element 64 may consist of movable pins 63 configured to extend from upper edge 56 and retract into body 34 to alternately engage with and disengage with mating feature 42, which may include two mating feature elements into which pins 63 can extend. Actuators 62 may be provided, such as hydraulic actuators, for actuating pins 63. In one embodiment, machine 10 may include an implement coupler of the type taught in copending and commonly owned U.S. patent application Ser. No. 11/443,066.

Also shown in FIG. 3 is implement grabber 36, comprising at least one hooking element 36, extending upwardly from upper edge 56. In the embodiment shown in FIG. 3, grabber 36 is engaged with a bracket 40*a*, separate from mating feature 42, and configured to receive grabber 36 to enable grabbing of implement 38 when disposed laterally of machine 10 relative to axis A and/or frame 12. A second bracket 40*b*, disposed on implement 38 and also separate from feature 42, may also be provided, and is also configured to engage with grabber 36, as further described herein. Implement 38 may also include one or more support extensions 39 which are configured to support implement 38 in a more or less upright orientation, approximately as shown in FIG. 3, enabling relatively easy grabbing of implement 38 and movement to a mounting location relative to axis A and/or frame 12 whereat mounting element 64 can engage with mating feature 42. It will further be noted from FIG. 3 that brackets 40*a* and 40*b* are disposed on opposite sides of a centerline C of implement 38, and are positioned between the elements of mating feature 42, for reasons which will be apparent from the following description.

Figure 4:
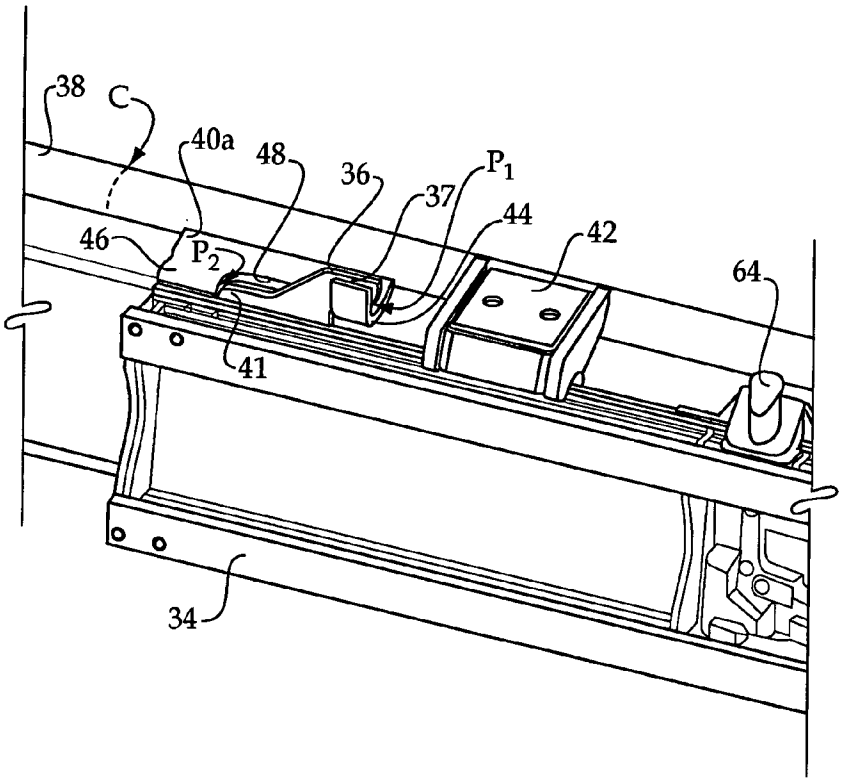
FIG. 4 is a partial pictorial view of a coupler assembly and implement as in FIG. 3.

Referring also to FIG. 4, showing a close-up view of certain of the features of coupler assembly 32 and implement 38, grabber 36 may be received in a slot 48 of bracket 40*a*, slot 48 extending between and being defined by a first curved portion 44 and a second curved portion 46 of bracket 40*a*. In one embodiment, grabber 36 may be inserted into slot 48 from below, then adjusted via sideshift movement of coupler assembly 32 such that a hook portion 37 of grabber 36 engages at a first reaction point $P_1$ with curved portion 44 of bracket 40*a*. A flange portion 41 of grabber 36 can at the same time engage with the other curved portion 46 of bracket 40*a* at a second reaction point $P_2$. It will be recalled that bracket 40*a* may be disposed on one side of centerline C of implement 38. In one embodiment, coupler assembly 32 will be used to elevate implement 38 off of the ground when grabber 36 is used to retrieve or dispose of implement 38. Because grabber 36 will typically initially engage implement 38 via a single bracket 40*a*, dual reaction points will inhibit implement 38 tilting. In other words, to provide a solid pick-up of implement 38 for elevating it without tilting, interaction between grabber 36 and bracket 40*a* at two locations is desired to react the tilting forces on coupler assembly 32.

To this end, during a typical pick-up and retrieval sequence, further described herein, when coupler assembly 32 is used to elevate implement 38, simultaneous interaction between grabber 36 and bracket 40*a* at the two illustrated reaction points $P_1$ and $P_2$, will keep implement 38 from tilting. Initial grabbing of implement 38 will typically be followed by moving implement 38 a first distance in a direction transverse to axis A. Where implement 38 is retrieved from a location lateral of frame 12 for mounting, after grabbing implement 38 at the location on the implement 38 shown in FIGS. 3 and 4, i.e. via bracket 40*a*, implement 38 will typically be moved via sideshifting coupler assembly 32 toward axis A. Prior to initiating a retrieval sequence, a second implement, no longer appropriate for the type of work, worn, etc. may be decoupled from coupler assembly 32.

Figure 5:
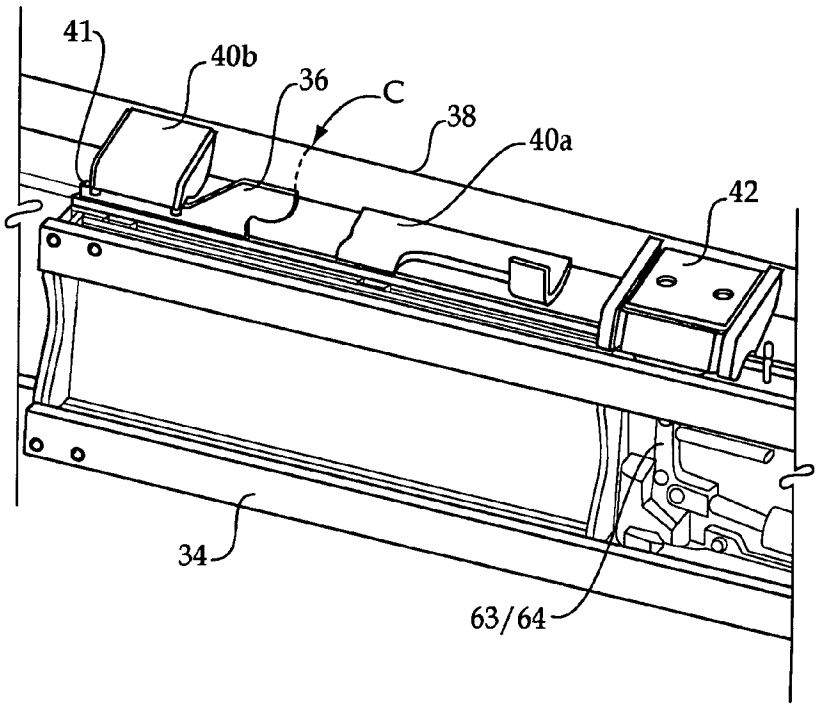
FIG. 5 is a partial view of the coupler assembly and implement of FIGS. 3 and 4 shown in a different configuration.

Referring now also to FIG. 5, after moving implement 38 a first distance, grabber 36 may be used to move implement 38 a second distance via grabbing implement 38 at a different location, and in a different manner. In particular, after engaging grabber 36 with bracket 40*a*, implement 38 may be lowered to the ground, grabber 36 disengaged from slot 48, and coupler assembly 32 extended and raised such that grabber 36, for instance flange portion 41, engages with second bracket 40*b*, and mounting element 64 engages with part of mating feature 52, for example via engaging of one of pins 63 therewith. It will be noted that in the FIG. 5 illustration, grabber 36 engages with bracket 40*b* on one side of centerline C of implement 38, whereas the rightmost part of mating feature 42 and mounting element 64 are engaged on an opposite side of centerline C. In the configuration shown in FIG. 5, since implement 38 is being picked up at two locations on opposite sides of its center of gravity, implement 38 will have a reduced or zero tendency to tilt as compared with the configuration shown in FIG. 4.

Figure 6:
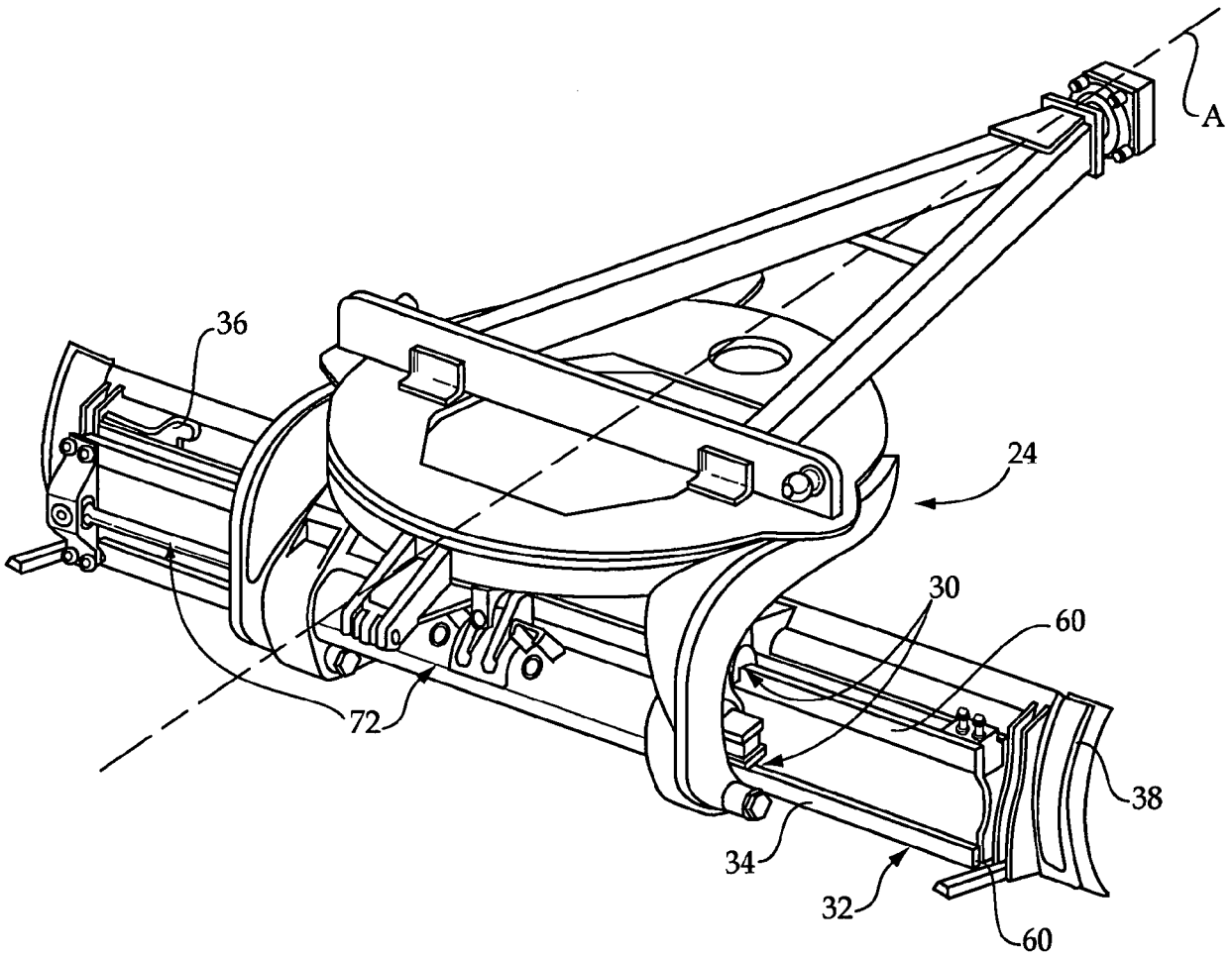
FIG. 6 is a pictorial view showing an implement mounted to a coupler assembly according to one embodiment.

Referring to FIG. 6, once implement 38 has been moved via sideshift movement of coupler assembly 32 to a position at which coupler assembly 32 can be adjusted to properly align the components of mounting element 64 with the components of mating feature 42, actuators 62 may be actuated to urge pins 63 into brackets 42. FIG. 6 illustrates implement 38 and coupler assembly 32 in a mounted configuration at which implement 38 is ready for use with machine 10. Also shown in FIG. 6 is a hydraulic actuator 72 configured for moving coupler assembly 32 in sideshift directions transverse to axis A, and retention assembly 30 configured to support coupler assembly 32 for sideshifting via rails 60.

INDUSTRIAL APPLICABILITY

Referring to the drawing Figures generally, and in particular to FIG. 2, when it is desirable to retrieve an implement such as implement 38 for mounting on coupler assembly 32 and use, machine 10 may be driven to a position at which implement 38 may be reached with grabber 36. Those skilled in the art will appreciate that coupler assembly 32 will typically be highly maneuverable, and can be moved up and down in a direction perpendicular axis A, moved via sideshift movement transverse to axis A, tilted, swung and rotated. Thus, there will generally be a degree of flexibility in positioning machine 10 for retrieving implement 38. Further, while implement 38 may comprise one of numerous types of grader blades, it should be appreciated that a variety of other implement types such as mowers, angled brooms, cold planers, etc. might be used. The flexibility in implement positioning for retrieval and disposal offered by the present disclosure will enable a wide variety of implement types to be readily used, in contrast to earlier designs having factory installed blades and designs wherein a supplemental implement was mounted to the grader blade itself.

Once machine 10 is positioned as desired, an operator may command sideshift movement of coupler assembly 32 in a direction transverse and away from axis A, then execute the necessary maneuvers to engage grabber 36 in slot 48. Once grabber 36 is within slot 48, the operator may command sideshift movement of coupler assembly 32 in an opposite direction, back toward axis A, to bring hook portion 37 into engagement with curved portion 44 of bracket 40*a* and flange portion 41 into engagement with curved portion 46 of bracket 40*a*. Engagement of grabber 36 as described will provide the two reaction points mentioned above, and will enable elevating implement 38 without tilting. It should be appreciated, however, that elevating implement 38 is not critical and in some embodiments, or with certain implement types, implement 38 might be simply dragged across the ground.

With grabber 36 engaged in slot 48, the operator may thenceforth command elevating of coupler assembly 32, for example via lift cylinders 80 coupled with drawbar 26, and commence sideshift movement of coupler assembly 32 with implement 38 engaged via grabber 36 back toward axis A. After implement 38 has been moved a desired distance toward axis A, it may be lowered, and grabber 36 engaged with bracket 40*b*, as described above, and additional lift, sideshift and lower sequences executed until implement 38 is positioned where mating feature 42 is accessible to mounting element 64. Subsequently, mounting element 64 may be actuated to engage with mating feature 42. Where implement 42 comprises a hydraulically actuated implement, for example including a hydraulic motor or cylinder, appropriate hydraulic connections may be made to prepare implement 38 for use. When it is desirable to dispose of implement 38, for example, swapping it with a different implement, the aforementioned steps may be carried out in reverse to incrementally return implement 38 to a storage/disposal location.

The length of implement 38, as well as the range of motion of coupler assembly 32, as defined by its extreme attainable sideshift positions, will tend to affect the number of sideshift motions that are necessary to move implement 38 from a disposal location to a mounting location when retrieving implement 38, or from a mounting location to a disposal location when disposing of implement 38. To this end, grabber 36 might include a plurality of hooking elements, or one or more hooking elements disposed at different locations on coupler assembly 32 than the illustrated positions, depending upon the implements contemplated for use with machine 10. Implement 38 might also be configured differently, and might include features specific to a particular coupler assembly design. Further still, rather than hooking elements, grabber 36 might comprise another type of engagement feature for grabbing an implement. In certain embodiments, grabber 36 might include a hydraulically actuated feature configured to grab or assist in grabbing an implement.

The present disclosure provides substantial improvements over known designs and implement positioning and coupling strategies. Rather than driving over an implement, dragging an implement, excessive backing and turning or some other strategy, the present disclosure will provide a simple, elegant means of retrieving and disposing of implements which are otherwise challenging or impossible to mount to a motor grader. The features and strategy described herein are contemplated to significantly improve motor grader utilization, flexibility and even performance due to the ability to readily apply an implement best suited to a particular task.

The present description is for illustrative purposes only, and should not be construed to narrow the breadth of the present disclosure in any way. Thus, those skilled in the art will appreciate that various modifications might be made to the presently disclosed embodiments without departing from the full and fair scope of the present disclosure. Other aspects, features and advantages will be apparent upon an examination of the attached drawings and appended claims.

What is claimed is:

1. An implement assembly in combination with a motor grader comprising:

a coupler assembly having a front side, a back side opposite said front side and a width dimension, said coupler assembly being configured for movement relative to a frame of the motor grader in a direction aligned with said width dimension;

said coupler assembly mounted between front and rear ground supports of the motor grader;

a mounting element configured to engage with a mating feature of an implement for mounting the implement at the front side of said coupler assembly; and an implement grabber mounted to said coupler assembly and including at least one hooking element, said implement grabber being configured for grabbing the implement via the at least one hooking element, lifting the implement from the ground, and moving the implement laterally relative to the motor grader by moving said coupler assembly in a direction aligned with said width dimension to a mounting location at which the mounting element of said coupler assembly can engage with the mating feature of the implement.

2. The implement assembly of claim 1 wherein said coupler assembly includes a body, and wherein said mounting element comprises at least one actuator coupled with movable members disposed at least partially within the body of said coupler assembly.

3. The implement assembly of claim 1, including a bracket configured to engage with the at least one hooking element and defining a first and a second reaction point with the at least one hooking element.

4. The implement assembly of claim 3, wherein the bracket is a first bracket, and the implement assembly further includes a second bracket disposed on an opposite side of a center of gravity of the implement, wherein the second bracket is configured to engage with the hooking element.

5. The implement assembly of claim 3, wherein the bracket includes a slot configured to receive the hook and defined in part by a first curved portion and a second curved portion of the bracket.

6. The implement assembly of claim 1, wherein the mounting element includes a first pin and a second pin.

7. The implement assembly of claim 1, wherein the hooking element includes a hook extending upwardly from the upper edge of the coupler assembly.

8. The implement assembly of claim 1, wherein the coupler assembly is vertically movable relative to the frame of the motor grader.

9. An implement assembly in combination with a motor grader comprising:

a coupler assembly having a front side, a back side opposite said front side and a width dimension, said coupler assembly being configured for movement relative to a flame of the motor grader in a direction aligned with said width dimension;

said coupler assembly mounted between front and rear ground supports of the motor grader;

a mounting element configured to engage with a mating feature of an implement for mounting the implement at the front side of said coupler assembly; and an implement grabber mounted to said coupler assembly and including at least one hooking element, said implement grabber being configured for grabbing the implement and moving the implement with said coupler assembly to a mounting location at which the mounting element of said coupler assembly can engage with the mating feature of the implement;

wherein said coupler assembly includes a body, and wherein said mounting element comprises at least one actuator coupled with movable members disposed at least partially within the body of said coupler assembly; and wherein the body of said coupler assembly includes an upper edge and a lower edge, said mounting element being configured to extend from the upper edge of said coupler body, and wherein said implement grabber includes at least one hooking element disposed on the upper edge of said coupler assembly at a location different from a location of said mounting element.

10. The implement assembly of claim 9 further comprising a circle and drawbar assembly configured to suspend said coupler assembly below the frame of the motor grader, wherein said at least one actuator includes at least one hydraulic actuator configured to actuate said mounting element to mount the implement on said coupler assembly and below the frame of the motor grader.

11. The implement assembly of claim 9, including a bracket on the implement configured to engage with the at least one hooking element and defining a first and a second reaction point with the at least one hooking element.

12. The implement assembly of claim 11, wherein the bracket is a first bracket, the implement assembly further includes a second bracket disposed on an opposite side of a center of gravity of the implement, and the second bracket is configured to engage with the hooking element.

13. The implement assembly of claim 9, wherein the mounting element includes a first pin and a second pin.

14. The implement assembly of claim 9, wherein the hooking element includes a hook extending upwardly from the upper edge of the coupler assembly.

15. The implement assembly of claim 14, including a bracket on the implement wherein the bracket wherein the bracket includes a slot configured to receive the hook and defined in part by a first curved portion and a second curved portion of the bracket.

16. The implement assembly of claim 9, wherein the coupler assembly is vertically movable relative to the frame of the motor grader.

* * * * *